United States Patent [19]

Hiller

[11] 4,207,108

[45] Jun. 10, 1980

[54] SILVER HALIDE PHOTOTHERMOGRAPHIC ELEMENT, COMPOSITION AND PROCESS

[75] Inventor: Gary L. Hiller, Hilton, N.Y.

[73] Assignee: Eastman Kodak Company, Rochester, N.Y.

[21] Appl. No.: 877,453

[22] Filed: Feb. 13, 1978

Related U.S. Application Data

[63] Continuation-in-part of Ser. No. 738,938, Nov. 4, 1976, abandoned.

[51] Int. Cl.[2] ..... G03C 1/02; G03C 5/30

[52] U.S. Cl. ..... 430/354; 96/67; 96/114.1; 430/155; 430/67

[58] Field of Search ..... 96/114.1, 48 HD, 107, 96/67, 66 T, 94 R

[56] References Cited

U.S. PATENT DOCUMENTS

| | | | |
|---|---|---|---|
| 3,669,672 | 6/1972 | Shiba et al. | 96/126 |
| 3,761,279 | 9/1973 | deMauriac | 96/114.1 |
| 3,776,738 | 12/1973 | Ohlschlager et al. | 96/107 |
| 3,785,822 | 1/1974 | Overman | 96/107 |
| 3,801,321 | 4/1974 | Evans et al. | 96/114.1 |
| 3,839,041 | 10/1974 | Hiller | 96/114.1 |
| 3,870,523 | 3/1975 | Ikenoue et al. | 96/114.1 |
| 3,874,946 | 4/1975 | Costa et al. | 96/114.1 |
| 3,895,948 | 7/1975 | Shiba et al. | 96/107 |
| 3,909,271 | 9/1975 | Ikenoue et al. | 96/114.1 |
| 4,001,020 | 1/1977 | Hayashi et al. | 96/107 |
| 4,021,240 | 5/1977 | Cerquone et al. | 96/114.1 |

FOREIGN PATENT DOCUMENTS

| | | | |
|---|---|---|---|
| 2547723 | 4/1976 | Fed. Rep. of Germany | 96/114.1 |

OTHER PUBLICATIONS

Research Disclosure, Feb. 1977, pp. 38–39, Item 15442–Hiller.

*Primary Examiner*—J. Travis Brown
*Attorney, Agent, or Firm*—Richard E. Knapp

[57] ABSTRACT

Improved photographic speed is provided in a photothermographic material comprising in reactive association (a) photosensitive silver halide, (b) an oxidation-reduction image-forming combination comprising (i) a long-chain fatty acid silver salt oxidizing agent, with (ii) a reducing agent, (c) a synthetic polymeric binder, and (d) a photographic speed increasing concentration of a certain non-dye, thione speed increasing addendum. A developed image having increased photographic speed can be provided in the described photographic material, after imagewise exposure, by heating the element to moderately elevated temperatures.

38 Claims, No Drawings

SILVER HALIDE PHOTOTHERMOGRAPHIC ELEMENT, COMPOSITION AND PROCESS

This is a continuation-in-part patent application of U.S. Ser. No. 738,938 of Gary L. Hiller, filed Nov. 4, 1976 now abandoned.

BACKGROUND OF THE INVENTION

1. Field of the Invention

This invention relates to improved photothermographic materials and processes for preparing them. In one of its aspects it relates to certain photothermographic elements having improved photographic speed. In another of its aspects it relates to certain photothermographic compositions comprising photosensitive silver halide with a certain oxidation-reduction image-forming combination, a synthetic polymeric binder and certain photographic speed increasing compounds. In another of its aspects it relates to preparation of the described photothermographic materials.

2. Description of the State of the Art

Photothermographic materials and methods of their preparation are known. Such photothermographic materials after imagewise exposure can be heated to provide a developed image in the absence of separate processing solutions or baths. Typical photothermographic materials are described, for example, in U.S. Pat. No. 3,152,904 of Sorenson et al, issued Oct. 13, 1964; U.S. Pat. No. 3,457,075 of Morgan et al, issued July 22, 1969; U.S. Pat. No. 3,392,020 of Yutzy et al, issued July 9, 1968; British Specification 1,161,777 published Aug. 20, 1969; and U.S. Pat. No. 3,801,321 of Evans et al, issued Apr. 2, 1974.

It has been desirable to provide increased photographic speed for the photothermographic elements, as described, comprising (a) photosensitive silver halide, (b) an oxidation-reduction image-forming combination comprising (i) a long-chain fatty acid silver salt oxidizing agent, such as silver behenate or silver stearate, with (ii) a reducing agent, especially a sulfonamidophenol reducing agent, in (c) a synthetic polymeric binder, such as poly(vinyl butyral). Photographic speed as used herein is intended to mean the sensitivity to ranges of electromagnetic radiation to which the photothermographic materials are exposed imagewise to provide a latent image. Increased photographic speed is typically demonstrated by comparison of sensitometric curves, also known as H and D curves, resulting from sensitometric exposure of a photothermographic element followed by heating the element to develop the latent image. Photographic speed as used herein is expressed in terms of relative speeds in which a control is assigned a relative speed of 100. It has also been desirable in some cases to provide increased contrast and maximum density of the images produced with the described photothermographic materials.

One means which has been proposed to increase photosensitivity centers upon preparation of photosensitive silver halide in the photothermographic materials. This method provides what has been described as silver halide formation in situ. This is described, for example, in U.S. Pat. No. 3,457,075 of Morgan et al, issued July 22, 1969. Preparation of the photosensitive silver halide in situ is difficult to control. It is desirable to provide the photosensitive silver halide separate from other components of the photothermographic material and then mix the silver halide with the described components. This silver halide, prepared separately from other components of the photothermographic material, is referred to herein as ex situ silver halide. Photothermographic materials containing ex situ silver halide are described, for example, in U.S. Pat. No. 3,871,887 of Jones, issued Mar. 18, 1975. It has been desirable, however, to provide photographic speed in certain photothermographic materials beyond that provided alone by preparation of the silver halide either by in situ or ex situ methods.

Another means proposed for providing increased photographic speed in photothermographic materials has been the addition of onium halides to the photothermographic material as described, for example, in U.S. Pat. No. 3,679,422 of deMauriac et al, issued July 25, 1972. It has been found that mere addition of equivalent amounts of bromide ion or bromide compounds does not provide desired increase in sensitivity. Also, mere addition of silver iodide to a photothermographic composition, as described, has not been found to provide the desired increased photographic speed.

It is also known that a variety of mercapto heterocyclic compounds can be useful in photographic materials, such as photographic emulsions and processing solutions. These mercapto heterocyclic compounds have not been used in photothermographic materials to provide increased photographic speed. For example, spectral sensitizing dyes containing a mercapto heterocyclic moiety have been added to photographic materials in order to increase spectral sensitivity, but not to increase photographic speed of photothermographic materials as described herein. Certain mercapto heterocyclic compounds have been found useful in photothermographic materials, for example, for providing post-processing image stability as described, for example, in U.S. Pat. No. 3,839,041 of Hiller, issued Oct. 1, 1974. Mercaptotetrazole compounds have also been found useful for certain purposes in photothermographic materials as described, for example, in U.S. Pat. No. 3,666,477 of Goffe, issued May 30, 1972. Certain 2-mercaptosubstituted heterocyclic compounds have been used to provide chemical sensitization of photographic gelatino silver halide emulsions also. This is described, for example, in U.S. Pat. No. 3,785,822 of Overman, issued Jan. 15, 1974. It is also known to add certain thiazoline-2-thione compounds to conventional photographic silver halide emulsions to provide increased light sensitivity and improved black image tone. This is described, for example, in U.S. Pat. No. 3,433,640 of Nishio et al, issued Mar. 18, 1969. This description, however, does not relate to photothermographic materials containing an oxidation-reduction image-forming combination.

A variety of spectral sensitizing dyes are known to be useful in photothermographic materials as described in the above patents. Useful spectral sensitizing dyes are described, for example, in U.S. Pat. No. 3,761,279 of deMauriac et al, issued Sept. 25, 1973 and include merocyanine dyes, for instance, containing a rhodanine, thiohydantoin or 2-thio-2,4-oxazolidinedione nucleus. Spectral sensitizing dyes as a class, however, have not been found to provide the desired increased photographic speed, increased maximum density and contrast characteristics of the described photothermographic elements containing photosensitive silver halide with an oxidation-reduction image-forming combination. This is illustrated, for example, by the comparative data in U.S. Pat. No. 3,761,279.

Accordingly, there has been a continuing need to provide improved photothermographic materials and processes for preparing such materials using photosensitive silver halide with an oxidation-reduction image-forming combination comprising a long-chain fatty acid silver salt oxidizing agent with a reducing agent, especially a sulfonamidophenol reducing agent.

SUMMARY OF THE INVENTION

It has been found according to the invention that the described advantages are provided in a photothermographic material comprising (a) photosensitive silver halide, in reactive association with (b) an oxidation-reduction image-forming combination comprising (i) a long-chain fatty acid silver salt oxidizing agent, with (ii) a reducing agent, especially a phenolic reducing agent, (c) a synthetic polymeric binder, such as poly(vinyl butyral), and (d) a photographic speed increasing concentration of a non-dye, thione speed increasing addendum represented by the formula:

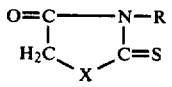

wherein R is alkyl containing 1 to 8 carbon atoms, and X is O or S. The photographic speed increasing concentration is typically within the range of $1\times10^{-7}$ to $1\times10^{-3}$ moles of the described thione speed increasing addendum per mole of total silver in the photothermographic material.

It has also been found according to the invention that the described photothermographic material can be prepared with in situ and/or ex situ photosensitive silver halide. One process of preparing a photothermographic material according to the invention with in situ photosensitive silver halide comprises respectively (A) mixing the following components: (a) a long-chain fatty acid silver salt, as described herein, (b) a long-chain fatty acid, such as behenic acid or stearic acid, (c) a suitable polymeric binder, especially poly (vinyl butyral), (d) an alkali metal bromide, such as sodium bromide, in (e) a suitable solvent, especially a mixture of acetone and toluene, then (B) mixing the composition from (A) with a solution, such as an acetone solution, of a sulfonamidophenol reducing agent, and subsequently (C) mixing the resulting composition with a photographic speed increasing concentration of a non-dye, thione speed increasing addendum, as described. It is often desirable, however, to prepare the described photothermographic material according to the invention with ex situ silver halide to enable better control in preparation of the components.

DETAILED DESCRIPTION OF THE INVENTION

The term "photographic speed increasing concentration" is intended to refer to that concentration which provides an increase in relative photographic speed of the described photographic material, especially an increase in speed of at least about 0.30 log E. The optimum useful concentration will depend upon a variety of factors including, for instance, the particular photothermographic material, particular photosensitive silver halide, the processing conditions, the desired image, particular speed increasing addendum and the like. Typically, the speed increasing concentration is within the described range of $1\times10^{-7}$ to $1\times10^{-3}$ moles of the described thione speed increasing addendum per mole of total silver in the photothermographic material. A simple test can be used for determining the desired concentration. One useful test is described in following Example 1 in which the speed increasing addendum is 3-ethyl-2-thio-2,4-oxazolidinedione. The concentration of this speed increasing addenda can be varied in the described composition of this example until the desired maximum speed is obtained without significantly adversely affecting other desired properties of the photothermographic material.

The term "alkyl group" as used herein is intended to include unsubstituted alkyl groups and alkyl groups which contain substituent groups which do not adversely affect the desired increased photographic speed or other desired properties of the photothermographic element. Useful substituent groups include, for example, methoxy, carboxy, sulfonic acid, phenyl and the like groups.

Examples of useful compounds within the described formula for the desired thione speed increasing addenda include those wherein R is methyl, $C_2H_5$-,

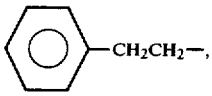

$CH_3OCH_2CH_2$-, $HO_2CCH_2$-, $HO_3SCH_2CH_2$-, and $C_7H_{15}$-.

The described photothermographic materials contain photosensitive silver halide as a photosensitive component due to its high degree of photosensitivity. It is believed that the latent image formed in the photosensitive silver halide upon exposure acts as a catalyst for the described oxidation-reduction image-forming combination. A typical concentration of photosensitive silver halide is within the range of about 0.01 to about 20 moles of photosensitive silver halide per mole of oxidizing agent in the photothermographic material. Useful photosensitive silver halides include, for example, silver chloride, silver bromide, silver bromoiodide, silver chlorobromoiodide or mixtures thereof. The photosensitive silver halide can be coarse or fine grain, very fine-grain photosensitive silver halide being especially useful. The photosensitive silver halide can be prepared by procedures known in the photographic art. Such procedures and forms of photosensitive silver halide are described, for example, in the Product Licensing Index, Volume 92, December 1971, publication 9232 published by Industrial Opportunities Ltd., Homewell, Havant, Hampshire, PO9 1EF, UK. An especially useful method of preparing photosensitive silver halide for the described photothermographic materials is one in which the photosensitive silver halide is prepared ex situ in the presence of a synthetic polymer peptizer. Poly(vinyl acetals), such as poly(vinyl butyral), are especially useful as peptizers in this preparation of ex situ silver halide. The procedure can be carried out in a non-aqueous medium under controlled reaction conditions. The photosensitive silver halide useful in the described photothermographic materials can be unwashed or washed, can be chemically sensitized, can be protected against the production of fog and/or stabilized against loss of sensitivity during keeping as described in the above Product Licensing Index reference.

The photothermographic materials of the invention comprise a silver salt oxidizing agent which is a silver salt of a long-chain fatty acid. The silver salt of the long-chain fatty acid is one which is resistant to darkening under illumination. An especially useful class of silver salts of long-chain fatty acids are those containing from 10 to 30 carbon atoms in the fatty acid chain. Such compounds include, for example, silver behenate, silver stearate, silver oleate, silver laurate, silver hydroxystearate, silver caprate, silver myristate and silver palmitate with silver stearate and silver behenate being especially useful. Combinations of silver salt oxidizing agents can be also useful. In some instances, silver salts which are not silver salts of long-chain fatty acids can be useful in combination with the silver salts of the long-chain fatty acids. Such silver salt oxidizing agents include, for example, silver benzoate, silver benzotriazole and the like. In most instances, however, silver behenate is most useful.

A variety of reducing agents, especially organic reducing agents, can be useful in the described oxidation-reduction image-forming combination. Phenolic reducing agents are especially useful, such as sulfonamidophenol reducing agents. Useful sulfonamidophenol reducing agents are described, for example, in U.S. Pat. No. 3,801,321 of Evans et al, issued Apr. 2, 1974. The sulfonamidophenol and other reducing agents useful according to the invention can be prepared employing known procedures in the art. A useful class of sulfonamidophenol reducing agent is represented by the structure:

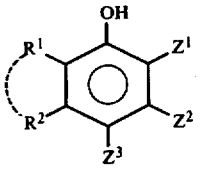

(I)

wherein $R^1$ and $R^2$ are each selected from the group consisting of hydrogen; chlorine; bromine; iodine; alkyl containing 1 to 4 carbon atoms, such as methyl, ethyl, propyl and butyl; aryl containing 6 to 12 carbon atoms such as phenyl and tolyl; arylsulfonyl containing 6 to 12 carbon atoms, such as phenylsulfonyl; amino; hydroxy; alkoxy containing 1 to 4 carbon atoms, such as methoxy and ethoxy; and atoms completing with $R^1$ and $R^2$ a naphthalene nucleus;

$Z^1$ and $Z^3$ are each selected from the group consisting of hydrogen; bromine; chlorine; alkyl containing 1 to 4 carbon atoms, as described, aryl containing 6 to 10 carbon atoms, such as phenyl and tolyl; arylsulfonyl containing 6 to 12 carbon atoms, as described; amino; hydroxy; alkoxy containing 1 to 4 carbon atoms, such as methoxy and ethoxy; and $R^6SO_2NH$— wherein $R^6$ is alkyl containing 1 to 4 carbon atoms, such as methyl, ethyl, propyl and butyl; aryl containing 6 to 10 carbon atoms, such as phenyl and tolyl and hetero ring substituents, such as thienyl, quinolinyl and thiazyl,

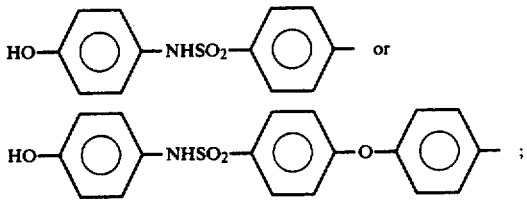

$Z^2$ is hydrogen, alkyl containing 1 to 4 carbon atoms, such as methyl, ethyl, propyl or butyl, chlorine and bromine when $R^1$ and $R^2$ are other than atoms completing a naphthalene nucleus; at least one of $Z^1$, $Z^2$ and $Z^3$ is $R^6SO_2NH$—.

The described groups such as alkyl, alkoxy and aryl include such groups containing substituents which do not adversely affect the reducing properties and desired sensitometric properties of the described photothermographic elements and compositions. Examples of substituent groups which can be present are alkyl containing 1 to 3 carbon atoms such as methyl, ethyl and propyl, chlorine, bromine and phenyl. In some cases it is desirable to avoid an amino group as a substituent. The amino group, in some cases, provides an overly active reducing agent.

One especially useful class of sulfonamidophenol reducing agents are compounds of the formula:

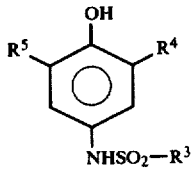

wherein $R^3$ is phenyl, naphthyl, methylphenyl, thienyl, quinolinyl, thiazyl, or alkyl containing 1 to 4 carbon atoms, as described;

$R^4$ is hydrogen, $R^6SO_2NH$—, alkoxy containing 1 to 4 carbon atoms, hydroxy, alkyl containing 1 to 4 carbon atoms, bromine or chlorine;

$R^5$ is hydrogen, bromine, chlorine, alkyl containing 1 to 4 carbon atoms, such as methyl, ethyl, propyl or butyl, or alkoxy containing 1 to 4 carbon atoms, such as methoxy, ethoxy and propoxy. $R^3$, $R^4$ and/or $R^5$ can contain substituent groups which do not adversely affect the reducing properties of the described sulfonamidophenol reducing agents or the desired sensitometric properties of the photothermographic elements and materials of the invention. These substituent groups are the same as described for generic structure I.

Another class of sulfonamidophenol reducing agents which are useful in photothermographic elements and compositions of the invention are sulfonamidonaphthols of the formula:

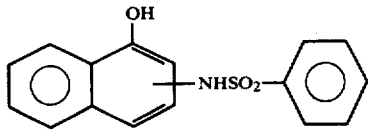

The sulfonamidophenol group in the described sulfonamidonaphthols can be in the ortho, meta or para position. The sulfonamidonaphthols are more active compounds within the sulfonamidophenol reducing agent class. Also, within this class, sulfonamidophenols which contain three sulfonamidophenol groups are more active. These sulfonamidophenols are employed for shorter developing times or with heavy metal salt oxidizing agents which are less active than silver behenate. In some cases, image discrimination provided by photothermographic materials containing the sulfonamidonaphthols and trifunctional sulfonamidophenols is less than that provided by other of the described sulfonamidophenols.

Combinations of sulfonamidophenol reducing agents, as described, can be useful in photothermographic materials and elements according to the invention. Especially useful sulfonamidophenol reducing agents include benzenesulfonamidophenol reducing agents, such as 2,6-dichloro-4-benzenesulfonamidophenol and/or 4-benzenesulfonamidophenol.

Other organic reducing agents, especially phenolic reducing agents, can be used alone or in combination with the described sulfonamidophenol reducing agents including, for example, those described in U.S. Pat. No. 3,672,904 of deMauriac, issued June 27, 1972. These reducing agents include, for instance, polyhydroxybenzenes, such as hydroquinone, alkyl-substituted hydroquinone, such as tertiarybutylhydroquinone, methylhydroquinone, 2,5-dimethylhydroquinone and 2,6-dimethylhydroquinone; catechols and pyrogallols; chloro-substituted hydroquinones, such as chlorohydroquinone or dichlorohydroquinone; alkoxy-substituted hydroquinone, such as methoxyhydroquinone or ethoxyhydroquinone; aminophenol developing agents, such as 2,4-diaminophenol and methylaminophenols; ascorbic acid developing agents, such as ascorbic acid, ascorbic acid ketals and other ascorbic acid derivatives; hydroxylamine developing agents; 3-pyrazolidone developing agents, such as 1-phenyl-3-pyrazolidone and 4-methyl-4-hydroxymethyl-1-phenyl-3-pyrazolidone and the like. Combinations of reducing agents can be useful in the photothermographic materials of the invention.

Selection of an optimum reducing agent or reducing agent combination will depend upon a variety of factors including, for instance, the particular photothermographic material, the particular silver salt oxidizing agent, processing conditions, desired image, particular speed increasing addenda and the like.

A photothermographic material, as described, can contain various synthetic polymeric binders, that is various non-gelatin binders, alone or in combination. Useful synthetic polymeric binders can be hydrophobic or hydrophilic. They are transparent or translucent and include such synthetic polymeric compounds as water soluble polyvinyl compounds like poly(vinyl pyrrolidone), acrylamide polymers and the like. Other synthetic polymeric compounds which can be useful include dispersed vinyl compounds, such as in latex form. Especially useful synthetic polymeric compounds are those which increase the dimensional stability of photographic materials. Effective polymers include water insoluble polymers of polyesters, polycarbonates, alkyl acrylates and methacrylates, acrylic acid, sulfoalkylacrylates, methacrylates and those having crosslinking sites which facilitate hardening or curing as well as those having recurring sulfobetaine units as described in Canadian Pat. No. 774,054. Especially useful high molecular weight synthetic polymeric materials include poly(vinyl butyral), cellulose acetate butyrate, polymethylmethacrylate, poly(vinyl pyrrolidone), ethyl cellulose, polystyrene, polyvinyl chloride, chlorinated rubber, polyisobutylene, butadiene-styrene copolymers, vinylchloride-vinylacetate-styrene copolymers, vinylchloride-vinylacetate copolymers, copolymers of vinylacetate, vinylchloride and maleic acid and polyvinyl alcohol. Combinations of synthetic polymeric binders can also be useful.

It is also useful to include an image stabilizer precursor in the photothermographic material as described in order to provide improved post-processing image stability. Useful post-processing image stabilizer precursors are described, for example, in U.S. Pat. No. 3,874,946 of Costa et al, issued Apr. 1, 1975 and include photolytically active halogen compounds, such as 2-tribromomethylsulfonylbenzothiazole. These compounds do not adversely affect the desired speed increasing properties of the speed increasing addenda according to the invention. The optimum concentration of an image-stabilizer precursor to be used in the described photothermographic material will depend upon such factors as the particular photosensitive material, the desired image stability, processing conditions and the like. A typical useful concentration of image stabilizer precursor is within the range of about 0.002 mole to about 0.75 mole of image stabilizer precursor per mole of total silver in the photothermographic material.

It is desirable, in some cases, to employ what has been described as a toning agent, also known as an activator toning agent or toner accelerator, in the photothermographic materials of the invention. These toning agents are typically useful for providing a more neutral (black) tone image upon processing. Useful toning agents are described, for example, in Belgian Pat. No. 766,590 issued June 15, 1971. Combinations of toning agents can be useful in the photothermographic materials of the invention if desired. Typical toning agents include, for example, phthalimide, N-hydroxyphthalimide, N-potassium phthalimide, succinimide, N-hydroxy-1,8-naphthalimide, N-hydroxysuccinimide, 1-(2H)-phthalazinone and the like.

The optimum concentration of image toner in the described photothermographic materials will depend upon a variety of factors including, for example, the particular photothermographic material, particular components of the photothermographic material, processing conditions, desired image tone, particular speed increasing addenda and the like. A typical useful concentration of image toner is within the range of about 0.10 mole to about 1.1 moles of image toner per mole of oxidizing agent. In some instances, it is not necessary or desirable to use an image toner in addition to other components in the photothermographic material.

Spectral sensitizing dyes can be useful in the described photothermographic materials of the invention to confer additional spectral sensitivity to the elements and compositions. Useful spectral sensitizing dyes are described, for example, in the *Product Licensing Index*, Volume 92, December 1971, publication 9232 in paragraph XV published by Industrial Opportunities Ltd., Homewell, Havant, Hampshire, PO9 1EF, UK. For optimum results the spectral sensitizing dye can be added to the photothermographic material either as a final step or at some earlier stage in preparation of the photothermographic material. Sensitizing dyes useful for providing additional sensitivity include, for example, the cyanines, merocyanines, complex (trinuclear or tetranuclear) merocyanines, complex (trinuclear or tetranuclear) cyanines, holopolar cyanines, styryls, hemicyanines, such as enamines, hemicyanines, oxonols and hemioxonols. Dyes of the cyanine classes can contain such basic nuclei as the thiazolines, oxazolines, pyrrolines, pyridines, oxazols, thiazoles, selenazoles, and imidazoles. Such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano or alkoxy groups. The dyes can be symmetrical or unsymmetrical and can contain alkyl, phenyl, enamine or heterocyclic substituents on the methine or polymethine chain. In those instances in which merocyanine dyes are used, the dyes can contain the basic nuclei described as well as acid nuclei, such as thiohydantoins, rhodanines, oxazolidinediones, thiazolidinediones, barbituric acids, thiazolinones, malanonitriles and the like. These acid nuclei can be substituted with alkyl, alkylene, phenyl, carboxyalkyl, sulfoalkyl, hydroxyalkyl, alkoxyalkyl, alkylamino groups or heterocyclic nuclei. Combinations of these dyes can be used if desired. In addition, supersensitizing addenda which do not absorb visible light may be included, such as for instance, ascorbic acid derivatives, azaindenes, cadmium salts and organic sulfonic acid compounds as described in the above *Product Licensing Index* publication. Typically useful spectral sensitizing dyes include 5-(γ-anilinoallylidene)-3-ethylrhodanine, 3-ethyl-5-[(3-ethyl-2-benzoxazolinylidene)ethylidene]-1-phenyl-2-thiohydantoin and 3-ethyl-5-[(3-ethyl-2-benzoxazolinyldene)-1-methylethylidene]rhodanine.

Photothermographic materials according to the invention can contain development modifiers that function as speed increasing compounds, hardeners, antistatic layers, plasticizers, lubricants, coating aids, brighteners, absorbing and filter dyes, and other addenda as described in the *Product Licensing Index*, Volume 92, December 1971, publication 9232 published by Industrial Opportunities Ltd., Homewell, Havant, Hampshire, PO9 1EF, UK.

The photothermographic elements according to the invention can comprise a variety of supports. It is essential, however, that the support be resistant to any adverse affects of the processing temperatures. Typical supports include cellulose ester film, poly(vinyl acetal) film, poly(ethylene terephthalate) film, polycarbonate film and related films or resinous materials, as well as glass, paper, metal and the like supports which can withstand the processing temperatures employed. Typically a flexible support is employed, such as a paper support.

The photothermographic compositions as described can be coated on a suitable support by various coating procedures known in the photographic art including dip coating, airknife coating, curtain coating or extrusion coating using hoppers, such as described in the above *Product Licensing Index* reference. If desired, two or more layers can be coated simultaneously also as described.

An especially useful embodiment of the invention is a photothermographic element comprising a support having thereon, in reactive association, (a) poly(vinyl butyral) peptized silver bromoiodide, (b) an oxidation-reduction image-forming combination comprising (i) silver behenate with (ii) a sulfonamidophenol reducing agent, such as 2,6-dichloro-4-benzenesulfonamidophenol, (c) a poly(vinyl butyral) binder, and (d) a speed increasing concentration of 3-ethyl-2thio-2,4-oxazolidinedione per mole of total silver in the photothermographic element, especially a concentration which is within the range of $1\times10^{-7}$ to $1\times10^{-3}$ moles of the thione compound per mole of total silver in the element.

A variety of imagewise exposure means and energy sources to which photosensitive silver halide is sensitive can be useful for producing a latent image in the described photothermographic material. The exposure means can be, for example, a light source, a laser, an electron beam or X-rays.

After imagewise exposure of the described photothermographic element according to the invention, the resulting image, typically a latent image, can be developed merely by heating the element to moderately elevated temperatures. This involves heating the described photothermographic element uniformly to a temperature within the range of about 80° C. to about 250° C., such as about 80° C. to about 170° C., until the desired image is developed. The time required to develop a useful image is typically within the range of about 1 to about 60 seconds, such as about 1 to about 30 seconds. By increasing or decreasing the length of time of heating, a higher or lower temperature within the described range can be useful depending upon the desired image. An especially useful processing temperature range is about 115° C. to about 175° C.

A variety of means can be used for providing the desired processing temperature for development of an image in the described photothermographic material. The heating means can be a simple hot plate, iron, roller, induction heating means or the like.

Processing is typically carried out under ambient conditions of pressure and humidity. Conditions outside normal atmospheric pressure and humidity can be employed if desired.

It is often useful to provide the photothermographic element with an overcoat layer in order to increase resistance to abrasion and other marks during processing. A variety of polymers can be useful in a protective layer on a photothermographic element as described. Typically, useful polymers include cellulose acetate, polyvinyl chloride, cellulose acetate butyrate, and the like. Combinations of polymeric materials can also be useful.

If desired, one or more components of the photothermographic material of the invention can be included in one or more layers of the photothermographic element. For example, in some cases it can be desirable to include certain percentages of the reducing agent, toner, stabilizer precursor or the like in the protective layer on the photothermographic element. This, in some cases, can reduce migration of certain addenda in the layers of the photothermographic element.

The photosensitive silver halide in a photothermographic element and composition according to the invention is in a physical location with respect to the described oxidation-reduction image-forming combination and the non-dye, thione speed increasing addendum to enable development of an image having increased photographic speed upon heating the element and composition to moderately elevated temperatures. In some cases, the non-dye, thione speed increasing addendum can be useful in one or more layers of a photothermographic element according to the invention. It is necessary that the photosensitive silver halide, the oxidation-reduction image-forming combination, and the non-dye, thione speed increasing addendum be in a physical location which enables the desired interaction of these components. In a preferred embodiment of the invention these components are in one layer of a photothermographic element according to the invention. The term "in reactive association" is intended herein to mean that the photosensitive silver halide is in a location in the photothermographic element and composition, as described, enabling the desired interaction.

The following examples are included for a further understanding of the invention.

EXAMPLE 1

This is a comparative example.

A silver behenate-behenic acid dispersion, Dispersion A, is prepared by combining the following components:

| | |
|---|---|
| silver behenate | 42.0 g |
| behenic acid | 16.0 g |
| lithium stearate | 3.0 g |
| poly(vinyl butyral) | 30.0 g |
| basic alumina | 11.0 g |
| acetone-toluene (1:1 parts by volume) | 500 ml |

A photothermographic element was prepared by combining 71 ml of the above Dispersion A with the following solutions, mixing the resulting composition, holding the composition in melt form for 18 hours and then coating the composition on a paper support at 0.74 gram of silver per square meter of support. The solutions mixed with Dispersion A were as follows:

| | |
|---|---|
| acetone solution containing 25% by weight 2,6-dichloro-4-benzenesulfonamidophenol | 5.0 ml |
| poly(vinyl butyral) peptized silver bromoiodide emulsion (6 mole % iodide, 100 g of polymer per mole of silver, 2.10 kg of emulsion per mole of silver) | 9.0 ml |
| acetone solution containing 2.5% by weight 2-tribromomethylsulfonylbenzothiazole | 6.0 ml |
| acetone-toluene (1:1 parts by volume) | 30.0 ml |

The photothermographic element was overcoated with the following mixture at 0.93 gram of cellulose acetate per square meter:

| | |
|---|---|
| cellulose acetate | 10 g |
| acetone solution containing 25% by weight 2,6-dichloro-4-benzenesulfonamidophenol | 10 ml |
| methyl ethyl ketone | 800 ml |

The resulting coating was permitted to dry to provide a photothermographic element. The element was imagewise exposed for 1 second to tungsten light to provide a developable latent image and was then uniformly heated for 5 seconds at 135° C. A developed image was produced. The sensitomeric results are given in following Table I.

EXAMPLE 2

The procedure and photothermographic material as described in Example 1 were repeated with the exception that the photothermographic composition also contained 3 ml of an acetone solution containing 0.01% by weight of 3-ethyl-2-thio-2,4-oxazolidinedione ($1.5\times10^{-5}$ moles per mole of total silver in the photothermographic element). The resulting photothermographic element was imagewise exposed as described in Example 1 and then uniformly heated also as described in Example 1. The sensitometric results are also given in following Table I.

A desired increase in photographic speed was observed with this speed increasing addenda at the described concentration in the photothermographic element of Example 1.

EXAMPLE 3

The procedure as described in Example 1 was repeated with the exception that the photothermographic composition before coating also contained 9.5 ml of an acetone solution of the spectral sensitizing dye, 5-(γ-anilinoallylidene)-3-ethylrhodanine ($0.95\times10^{-3}$ moles of dye per mole of total silver in the photothermographic material). The resulting photothermographic element was imagewise exposed as described in Example 1 and then uniformly heated, also as described in Example 1. A developed image was produced. The sensitometric results are given in following Table I.

The results illustrate that with the dye alone, in the absence of the speed increasing addenda of the invention, some increase speed is provided, but not the degree desired.

EXAMPLE 4

The procedure described in Example 1 was repeated with the exception that the photothermographic composition before coating also contained both the speed increasing addenda of Example 2 and the spectral sensitizing dye as described in Example 3 at the concentrations described in Examples 2 and 3 respectively. The resulting photothermographic element was imagewise exposed and then uniformly heated as described in Example 1. A developed image was produced. The sensitometric results are given in following Table I.

Table I

| Example | Compound | Dye** | Rel. Blue Speed* | Rel. Green Speed* | Contrast | Dmin | Dmax |
|---|---|---|---|---|---|---|---|
| 1 | — | — | 100 | — | 1.05 | 0.06 | 1.20 |
| 2 | I | — | 200 | — | 1.25 | 0.06 | 1.32 |
| 3 | — | A | 141 | 100 | 1.20 | 0.06 | 1.35 |
| 4 | I | A | 224 | 200 | 1.40 | 0.06 | 1.40 |

*speed measured at 0.60 density
**Dye A is 5-(γ-anilinoallylidene)-3-ethylrhodanine

EXAMPLE 5

The procedure as described in Example 2 was repeated with the exception that 3-ethylrhodanine was used in place of the oxazolidinedione speed increasing addenda of Example 2. Similar results were obtained to those observed for Example 2 using this rhodanine speed increasing addenda.

EXAMPLES 6–12

The procedure described in Example 1 was repeated with the exception that the thione speed increasing addenda described in following Examples 8–12 was added to the photothermographic material at a concentration equivalent to $1.5\times10^{-5}$ mole of the speed increasing addenda per mole of total silver in the photothermographic element. The resulting photothermographic element was imagewise exposed and then uniformly heated for 4 seconds at 135° C., 140° C. and 145° C. The resulting sensitometric curves obtained from these results were averaged to provide the data given in following Table II.

Table II

| Ex.-amples | 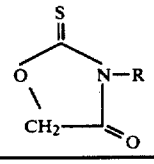 | Average Dmax | Relative Speed at 0.6 net density | Δ gamma |
|---|---|---|---|---|
| 6 (comparative example) | none | 1.0 | 100 | 0 |
| 7 | R = $C_2H_5$— | 1.4 | 174 | +1.6 |
| 8 | R = $OCH_2CH_2$— | 1.4 | 302 | +0.3 |
| 9 | R = $CH_3OCH_2CH_2$— | 1.4 | 138 | +2.1 |
| 10 | R = $HO_2CCH_2$— | 1.5 | 240 | 0 |
| 11 | R = $HO_3SCH_2CH_2$— | 1.4 | 200 | 0 |
| 12 | R = $C_7H_{15}$— | 1.5 | 234 | +0.9 |

The data in Table II indicate that a significant increase in relative speed is obtained with each of the listed thione speed increasing addenda and in some cases, such as in Examples 7, 8 and 9, a change in gamma is produced. In each case the maximum density of the developed image is increased compared to the control of Example 6.

The invention has been described in detail with particular reference to preferred embodiments thereof, but it will be understood that variations and modifications can be effected within the spirit and scope of the invention.

What is claimed is:

1. In a photothermographic element comprising a support having thereon
   (a) photosensitive silver halide, in reactive association with
   (b) an oxidation-reduction image-forming combination comprising
      (i) a long-chain fatty acid silver salt oxidizing agent, with
      (ii) a reducing agent, and
   (c) a synthetic polymeric binder, the improvement comprising
   (d) a photographic speed increasing concentration of a non-dye, thione speed increasing addendum represented by the formula:

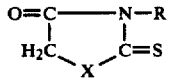

wherein R is alkyl containing 1 to 8 carbon atoms, and X is O or S.

2. A photothermographic element as in claim 1 wherein said photographic speed increasing concentration is within the range of $1\times10^{-7}$ to $1\times10^{-3}$ mole of said non-dye, thione speed increasing addendum per mole of total silver in said element.

3. A photothermographic element as in claim 1 wherein said non-dye, thione speed increasing addendum consists essentially of 3-ethyl-2-thio-2,4-oxazolidinedione.

4. A photothermographic element as in claim 1 wherein said oxidation-reduction image-forming combination consists essentially of silver behenate with 2,6-dichloro-4-benzenesulfonamidophenol.

5. A photothermographic element as in claim 1 wherein said polymeric binder consists essentially of poly(vinyl butyral).

6. A photothermographic element as in claim 1 also comprising an image stabilizer precursor.

7. A photothermographic element as in claim 1 also comprising an image stabilizer precursor consisting essentially of 2-tribromomethylsulfonylbenzothiazole.

8. A photothermographic element as in claim 1 also comprising an image toner.

9. A photothermographic element as in claim 1 also comprising an image toner consisting essentially of succinimide.

10. A photothermographic element as in claim 1 also comprising a spectral sensitizing dye.

11. A photothermographic element as in claim 1 also comprising a spectral sensitizing dye consisting essentially of 5-(γ-anilinoallylidene)-3-ethylrhodanine.

12. A photothermographic element as in claim 1 also comprising a spectral sensitizing dye consisting essentially of 3-ethyl-5-[(3-ethyl-2-benzoxazolinylidene)ethylidene]-1-phenyl-2-thiohydantoin.

13. A photothermographic element as in claim 1 also comprising a spectral sensitizing dye consisting essentially of 3-ethyl-5-[(3-ethyl-2-benzoxazolinylidene)-1-methylethylidene]rhodanine.

14. A photothermographic element as in claim 1 wherein said non-dye, thione speed increasing addendum consists essentially of a compound represented by the formula:

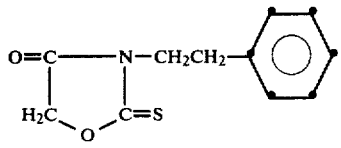

15. In a photothermographic element comprising a support having thereon
   (a) photosensitive silver halide, in reactive association with
   (b) an oxidation-reduction image-forming combination consisting essentially of
      (i) a long-chain fatty acid silver salt, with
      (ii) a sulfonamidophenol reducing agent,
   (c) a synthetic polymeric binder, the improvement comprising
   (d) a photographic speed increasing concentration of 3-ethyl-2-thio-2,4-oxazolidinedione.

16. A photothermographic element comprising a support having thereon
   (a) poly(vinyl butyral) peptized, photosensitive silver bromoiodide, in reactive association with
   (b) an oxidation-reduction image-forming combination consisting essentially of
      (i) silver behenate, with
      (ii) 2,6-dichloro-4-benzenesulfonamidophenol,
   (c) a poly(vinyl butyral) binder,
   (d) a spectral sensitizing dye, and
   (e) $1\times10^{-7}$ to $1\times10^{-3}$ mole of 3-ethyl-2-thio-2,4-oxazolidinedione per mole of total silver in the element.

17. In a photothermographic composition comprising
   (a) photosensitive silver halide, in reactive association with (b) an oxidation-reduction image-forming combination comprising
  (i) a long-chain fatty acid silver salt oxidizing agent, with
  (ii) a reducing agent, and
(c) a synthetic polymeric binder, the improvement comprising
(d) a photographic speed increasing concentration of a non-dye, thione speed increasing addendum represented by the formula:

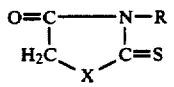

wherein R is alkyl containing 1 to 8 carbon atoms, and X is O or S.

18. A photothermographic composition as in claim 17 wherein said photographic speed increasing concentration is within the range of $1\times10^{-7}$ to $1\times10^{-3}$ mole of said non-dye, thione speed increasing addendum per mole of total silver in said element.

19. A photothermographic composition as in claim 17 wherein said non-dye, thione speed increasing addendum consists essentially of 3-ethyl-2-thio-2,4-oxazolidinedione.

20. A photothermographic composition as in claim 17 wherein said oxidation-reduction image-forming combination consists essentially of silver behenate with 2,6-dichloro-4-benzenesulfonamidophenol.

21. A photothermographic composition as in claim 17 wherein said polymeric binder consists essentially of poly(vinyl butyral).

22. A photothermographic composition as in claim 17 also comprising an image stabilizer precursor.

23. A photothermographic composition as in claim 17 also comprising an image stabilizer precursor consisting essentially of 2-tribromomethylsulfonylbenzothiazole.

24. A photothermographic composition as in claim 17 also comprising an image toner.

25. A photothermographic composition as in claim 17 also comprising an image toner consisting essentially of succinimide.

26. A photothermographic composition as in claim 17 also comprising a spectral sensitizing dye.

27. A photothermographic composition as in claim 17 also comprising a spectral sensitizing dye consisting essentially of 5-(γ-anilinoallylidene)-3-ethylrhodanine.

28. A photothermographic composition as in claim 17 also comprising a spectral sensitizing dye consisting essentially of 3-ethyl-5-[(3-ethyl-2-benzoxazolinylidene)ethylidene]-1-phenyl-2-thiohydantoin.

29. A photothermographic composition as in claim 17 also comprising a spectral sensitizing dye consisting essentially of 3-ethyl-5-[(3-ethyl-2-benzoxazolinylidene)-1-methylethylidene]rhodanine.

30. A photothermographic composition as in claim 17 wherein said non-dye, thione speed increasing addendum consists essentially of a compound represented by the formula:

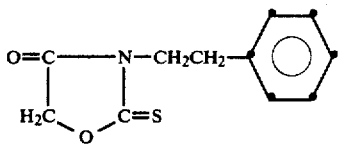

31. A photothermographic composition comprising
(a) photosensitive silver halide, in reactive association with
(b) an oxidation-reduction image-forming combination consisting essentially of
  (i) a long-chain fatty acid silver salt, with
  (ii) a sulfonamidophenol reducing agent,
(c) a synthetic polymeric binder, and
(d) a photographic speed increasing concentration of 3-ethyl-2-thio-2,4-oxazolidinedione.

32. A photothermographic composition comprising
(a) poly(vinyl butyral) peptized, photosensitive silver bromoiodide, in reactive association with
(b) an oxidation-reduction image-forming combination consisting essentially of
  (i) silver behenate, with
  (ii) 2,6-dichloro-4-benzenesulfonamidophenol,
(c) a poly(vinyl butyral) binder,
(d) a spectral sensitizing dye, and
(e) $1\times10^{-7}$ to $1\times10^{-3}$ mole of 3-ethyl-2-thio-2,4-oxazolidinedione per mole of total silver in the element.

33. A process of preparing a photothermographic composition comprising, respectively,
(A) mixing the following components:
  (a) a long-chain fatty acid silver salt,
  (b) a long-chain fatty acid,
  (c) poly(vinyl butyral),
  (d) an alkali metal bromide, in
  (e) a mixture of acetone and toluene,
(B) mixing the composition from (A) with an acetone solution of a sulfonamidophenol reducing agent, and then
(C) mixing the resulting composition with a photographic speed increasing concentration of a non-dye, thione speed increasing addendum represented by the formula:

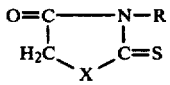

wherein R is alkyl containing 1 to 8 carbon atoms, and X is O or S.

34. A process as in claim 33 wherein said speed increasing concentration is within the range of $1\times10^{-7}$ to $1\times10^{-3}$ mole of said non-dye, thione speed increasing addendum per mole of total silver in said resulting composition.

35. A process of preparing a photothermographic composition comprising, respectively,
(A) mixing the following components: (a) silver behenate, (b) behenic acid, (c) poly(vinyl butyral), (d) sodium bromide, (e) a mixture of acetone and toluene,
(B) mixing the composition from (A) with an acetone solution of 4-chlorobenzenesulfonamidophenol, and then (C) mixing the resulting composition with a photographic speed increasing concentration within the range of $1\times10^{-7}$ to $1\times10^{-3}$ mole of 3-ethyl-2-thio-2,4-oxazolidinedione per mole of total silver in said resulting composition.

36. A process of developing an image in an exposed photothermographic element comprising a support having thereon (a) photosensitive silver halide, in reactive association with (b) an oxidation-reduction image-forming combination comprising (i) a long-chain fatty acid silver salt, with (ii) a reducing agent, (c) a synthetic polymeric binder, and (d) a photographic speed increasing concentration of a non-dye, thione speed increasing addendum represented by the formula:

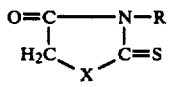

wherein R is alkyl containing 1 to 8 carbon atoms, and X is O or S;

comprising heating said element to a temperature within the range of about 80° C. to about 170° C. until said image is developed.

37. A process of developing an image in an exposed photothermographic element comprising a support having thereon (a) poly(vinyl butyral) peptized, photosensitive silver bromoiodide, in reactive association with (b) an oxidation-reduction image-forming combination consisting essentially of (i) silver behenate, with (ii) 2,6-dichloro-4-benzenesulfonamidophenol, (c) a poly(vinyl butyral) binder, (d) a spectral sensitizing dye, and (e) $1\times10^{-7}$ to $1\times10^{-3}$ mole of 3-ethyl-2-thio-2,4-oxazolidinedione per mole of total silver in the element;

comprising heating said element to a temperature within the range of about 100° C. to about 170° C. until said image is developed.

38. A process as in claim 37 comprising heating said element to a temperature within the range of about 100° C. to about 170° C. for about 1 to about 60 seconds until said image is developed.

* * * * *